United States Patent [19]

Hallworth

[11] Patent Number: 4,752,510

[45] Date of Patent: Jun. 21, 1988

[54] COATING SURFACES

[76] Inventor: Gerald Hallworth, 27 Nuttall Hall Rd., Ramsbottom, Lancashire, England

[21] Appl. No.: 828,528

[22] Filed: Feb. 12, 1986

[30] Foreign Application Priority Data

Feb. 14, 1985 [GB] United Kingdom ..... 8503859
Apr. 9, 1985 [GB] United Kingdom ..... 8509051
Dec. 30, 1985 [GB] United Kingdom ..... 8531895

[51] Int. Cl.[4] ..... B05C 1/10; B05D 1/28

[52] U.S. Cl. ..... 427/256; 427/288; 118/406; 118/407; 118/414

[58] Field of Search ..... 68/5 C, 200, 205 R, 68/202; 118/414, 415, 407, 406; 427/288, 256

[56] References Cited

U.S. PATENT DOCUMENTS 3,919,973 11/1975 Zimmer ..... 118/406
4,016,831 4/1977 James et al. ..... 118/415
4,094,241 6/1978 Kossler ..... 118/414 X
4,239,821 12/1980 McLean et al. ..... 118/415 X
4,357,373 11/1982 Cooper ..... 118/414

FOREIGN PATENT DOCUMENTS 2357833 11/1973 Fed. Rep. of Germany ..... 118/406

*Primary Examiner*—Shrive P. Beck
*Attorney, Agent, or Firm*—Fisher, Christen & Sabol

[57] ABSTRACT

A coating material is applied to a surface, such as the back surface of carpeting, using a perforated roller. The material is supplied to the outer surface of the roller so as to form a well of material on the surface passing through the perforated body of the roller up to a second similar roller inside the perforated roller. The roller may be fixed or may be driven depending on the nature of the pattern to be applied to the coating material by the roller.

2 Claims, 2 Drawing Sheets

COATING SURFACES

This invention relates to a method of applying coating materials to surfaces.

It is known to apply coating materials to substrates, for example to produce printed patterns, with a roller which comprises a hollow structure with a perforated outer wall through which fluent coating material is fed from within. The coating material is spread over the inner surface of the wall with an applicator blade and the action of the roller is to deposit coating material through the perforations onto the substrate. This technique is particularly convenient to perform and gives excellent results with even substrate surfaces. However, it can be difficult or impossible to achieve satisfactory results with uneven surfaces.

One object of the present invention is to provide a convenient coating technique which can give satisfactory results on uneven surfaces.

Carpeting is known which comprises a tufted fabric layer having a back surface which is bonded to an open-weave jute reinforcing fabric. The jute fabric is strong and hardwearing, has good appearance and feel simulating that of expensive carpeting, and can be readily bonded in a satisfactory manner to the back surface. However jute can be expensive and, being a natural product, may be subject to periodic availability problems. In substitution for jute it is known to use polypropylene. This can be less expensive and more readily available but in other respects it is not wholly satisfactory. For example it can be difficult to bond the polypropylene to the back surface in a secure and neat manner since the adhesive used for bonding purposes tends to flow through the reinforcing fabric rather than becoming absorbed as is the case with jute. It would also be possible to use in substitution for the jute fabric a thin layer of coating material. However, there is the problem that, if the coating layer is thin enough to give good feel and flexibility, the appearance may be unsatisfactory due to disruption of the coating material by the uneven back surface of the tufted fabric layer.

A further object of the present invention is to provide a method whereby a backing having good appearance and feel can be readily and conveniently applied to carpeting.

According to one aspect of the present invention therefore there is provided a method of applying a coating material to a surface wherein the surface is moved in contact with or in close proximity to a transfer member comprising a roller having a perforated outer wall and fluent coating material is fed to the roller wall so as to be deposited therefrom onto the said surface, characterised in that the coating material is fed to the outside of the wall so as to establish a well of the material between the wall and the surface whereby irregularities in the surface are filled and excess material is transferred through the wall to the interior of the roller.

With this procedure it is possible to achieve satisfactory results with uneven surfaces in so far as a variable thickness of material is applied in correspondence with variations in the evenness of the surface. That is, where the surface has a depression, additional material can be applied from the well to fill the depression before the requisite coating pattern or surface configuration is established. Where the coated surface is flat or raised the amount of coating material in contact with the surface can be depleted by transfer through the perforated roller wall.

The process of the invention can be applied to the production of a carpet backing layer and a layer conducive to good feel can be readily and conveniently applied. At the same time a good appearance can be achieved in so far as the roller imposes a predetermined pattern or surface configuration even where the back surface of the carpeting fabric layer to which the backing is applied is uneven. The carpeting fabric layer may be a tufted fabric layer of conventional form and the tufts may be secured in position at the back surface by application of an adhesive coating thereto prior to application of the patterned coating layer. The surface of the perforated roller may be of any desired regular or irregular configuration depending on the required surface pattern or configuration of the finished surface of the applied coating. A pattern simulating an open-weave fabric such as jute or hessian or similar mesh structure is possible.

In the context of carpeting, the method of the invention can be performed as a continuous process in a particularly convenient and efficient manner by advancing a tufted fabric layer through successive stages in which for example adhesive material for the purpose of securing in the tufts in position is applied (e.g. by spraying or spreading or by roller application etc.) on the back surface of the fabric layer, this adhesive material is caused or allowed to set, the patterned coating layer is applied to the secured back surface, and the coating layer is caused or allowed to set. The coating material for this application may comprise a foamed or non-foamed water-based polymer latex of the kind conventionally used for integral carpet backing and separate carpet underlay and this may contain an inorganic filler which may be sand as discussed in my copending application of even date and common priority.

The process of the invention permits what can be referred to as a wet embossing technique, that is a technique whereby an embossed pattern can be applied to an uneven substrate surface with the use of excess coating material sufficient to fill irregularities in the surface. The surface filling operation and the embossing can be effected simultaneously. It is not necessary first to fill or coat the surface and then emboss the requisite pattern—both of the operations can be performed at the same time with the same roller.

The coating material is preferably fed directly to the outside of the perforated roller or onto the surface adjacent the roller. The material may be applied from an outlet which is moved backwards and forwards across the surface along the perforated roller. The mode of deposition of the material from the perforated roller may be such that a raised pattern is formed with the raised portions corresponding to the perforations or such that a raised pattern is formed with the raised pattern corresponding to the solid parts of the roller between the perforations. A surface configuration which is generally flat is also possible.

According to a second aspect of the present invention there is provided apparatus for use in performing the above described method comprising a transfer member in the form of a roller having a perforated outer wall, a guide arrangement for moving a surface to be coated in contact with or in close proximity to the roller, a feed arrangement for feeding fluent coating material to the perforated roller to be deposited therefrom onto the surface, and an abutment for the coating material within the perforated roller, characterised in that said feed arrangement is arranged to supply said fluent coating material to the outside of said perforated outer wall so that it forms a well of such material between the said surface and the said abutment through the perforated wall.

The said abutment may comprise a doctor blade or a second smaller roller or other wiping device or wall structure in contact with or close to the inner surface of the perforated roller which assists in maintaining the required well.

In a particularly preferred embodiment the said abutment is defined by a second smaller roller which preferably (although not necessarily) has a solid, imperforate wall. This second roller may be fixed so as to be non-rotatable and may make sliding contact with the inner surface of the perforated roller or may be slightly spaced from such surface. With a fixed inner roller, contrary to the abovementioned conventional technique where raised parts of an embossed pattern are formed by the perforations, it is possible to obtain an embossed pattern with the raised portions formed by the solid parts of the roller between the perforations.

It is also possible to arrange for the inner roller to rotate either freely by contact with the perforated roller or drivably whilst in contact with or slightly spaced from the perforated roller. Where the inner roller is driven oppositely to the perforated roller, the abovementioned embossing effect may be made more pronounced. With the other rotational arrangements the pattern effect can be reversed i.e. so that the raised portions are formed by the perforations.

The present invention may be applied to the production of any suitable coating on any suitable surface. As mentioned above the surface may be the back of carpeting and the coating material may be a foamed or non-foamed polymer which sets to form a resilient backing layer on the carpeting. However it is also possible to utilise the invention with other surfaces whether of a flexible fabric nature or otherwise and the coating material may be applied as a thick continuous or discontinuous layer or a thin continuous or discontinuous layer having a generally flat top surface or an embossed top surface whether for decorative or structural purposes or otherwise. Depending on the application the coating material may be foamed or non-foamed and may be in the form of a printing ink, an adhesive, a structural polymer or other substance and may be applied in a solvent or as a settable composition and may be caused or allowed to dry or set as appropriate in any suitable manner. Depending on the application and the desired end result the size and distribution and pattern of the perforations in the outer wall will be appropriately selected. Thus, where a generally continuous layer which is of flat surface configuration or regular embossed pattern is required an appropriate regular arrangement of perforations will be used. Where an irregular pattern or a discontinuous layer is required there will be an appropriately irregular arrangement of perforations.

The invention will now be described further by way of example only and with reference to the following Examples and the accompanying drawings in which.

Figure 1:
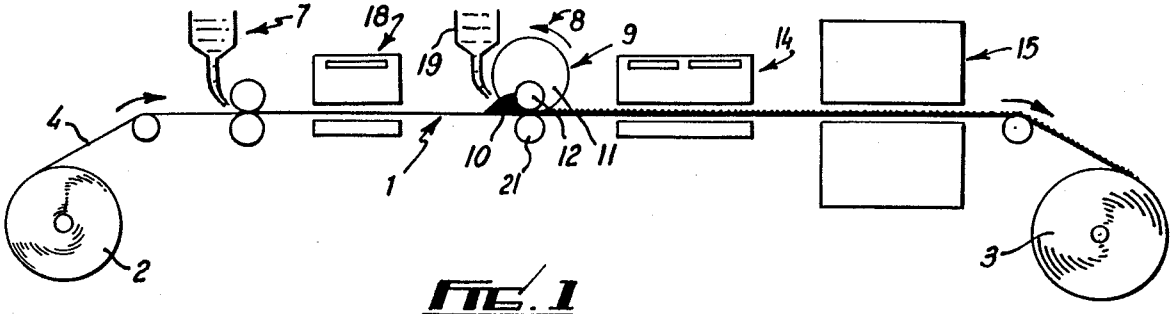
FIG. 1 is a schematic representation showing an arrangement for the application of coating material to carpeting in accordance with the method of the invention.
Figure 6:
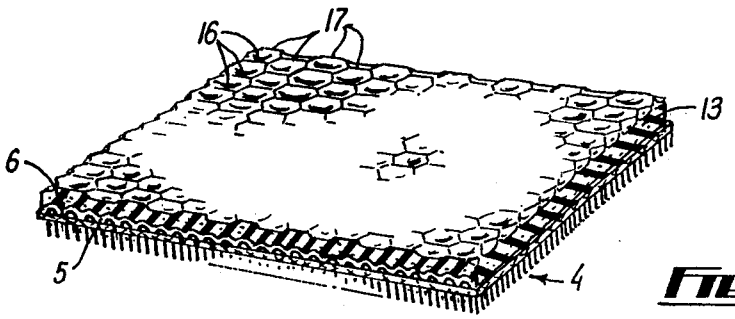
Figure 2:
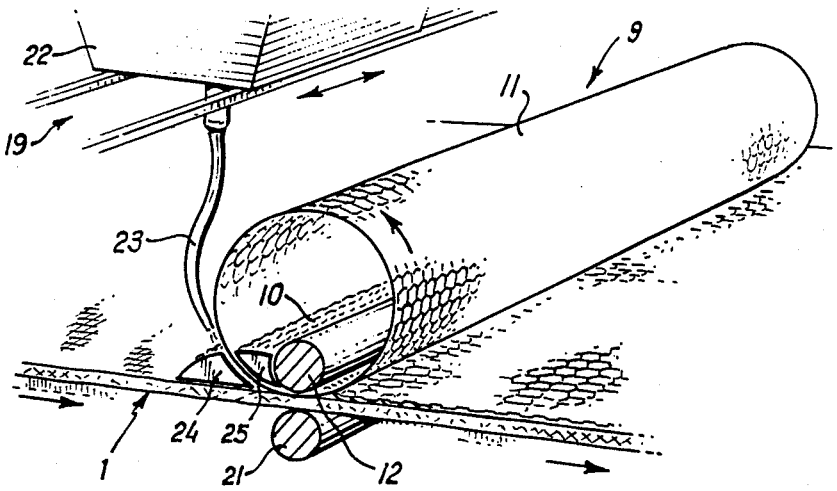
FIG. 2 is a diagrammatic perspective view of one form of coating apparatus according to the invention forming part of the arrangement of FIG. 1.
Figure 3:
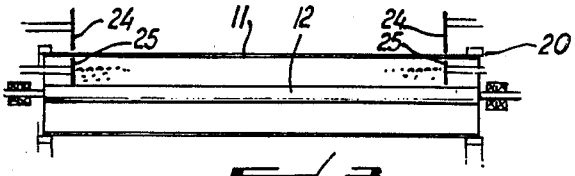
FIG. 3 is a diagrammatic longitudinal sectional view of the apparatus of FIG. 2.
Figure 4:
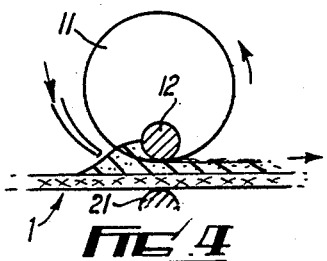
Figure 7:
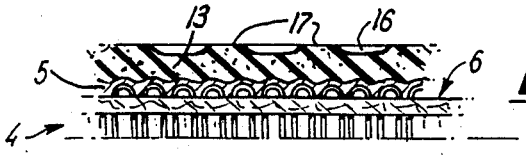

FIGS. 4+5 are diagrammatic axial sectional views of the apparatus of FIG. 2 in two different settings;

FIG. 6 is a diagrammatic perspective view of carpeting coated with the arrangement of FIG. 1;

FIG. 7 is a sectional view of the coated carpeting.

With reference to FIG. 1 tufted carpeting 1 is fed from a supply roll 2 through successive treatment stations to a take-up roll 3. The carpeting 1 on the supply roll comprises a layer of tufted fabric 4 and this is provided with a thin coating 5 (FIGS. 6 and 7) on its back surface 6 at a first treatment station 7. The coating material may be applied in any suitable manner e.g. by spraying or roller application and comprises an adhesive which sets to hold the carpet tufts securely in position on the back surface 6 of the fabric layer 4. The adhesive may comprise a water-based styrene-butadiene rubber latex and this is heated in an oven 18 to promote setting.

At a subsequent treatment station 8 the carpeting is passed beneath a large drivably rotated applicator roll 9 having an internal roller 12. The roll 9 has a cylindrical perforated body 11 and a fluent foam-forming mixture 10 is fed by apparatus 19 to the roll 9 so as to form a dam of the mixture between the roller 12 and the carpeting 1 through the body 11 across the width of the carpeting.

EXAMPLE 1

The foam-forming mixture 10 is formed by mixing the following main ingredients (in parts by dry weight):

| | |
|---|---|
| Styrene-butadiene rubber latex | 100.00 |
| Sodium hexametaphosphate (sequestering agent) | 0.50 |
| Disodium alkyl sulphosuccinamate (soap) | 4.00 |
| Sulphur (curing agent) | 2.00 |
| Zinc diethyldithiocarbamate (curing accelerator) | 1.50 |
| Mercaptobenzthiazole (curing accelerator) | 0.50 |
| Antioxidant | 1.00 |
| Zinc oxide (curing activator) | 1.50 |
| Sand 95 mesh (BS) | 350.00 |
| Xanthan gum | from 0.10 |
| Water to 78% by weight | total solids |
| pH 10.5 to 12.5 | |
| Viscosity 4000–5000 cps | |

The resulting mixture is a stable dispersion which is viscous but readily pourable. The mixture is mechanically foamed in conventional manner with compressed air in the apparatus 19 used to feed the mixture to the roll 9.

The roll 9 is rotated with the same peripheral speed as the carpeting 1. With the roll 9 the smaller roller 12 is fixed in non-rotating sliding contact with the inner surface of the body 11. The result of this is that the mixture is pressed by the solid parts of the roll body 11 onto the carpeting and forms a thin coating layer 13 on the back surface of the carpeting having a pattern determined by the roll solid parts. Excess mixture passes through the perforations and returns to the dam 10. The coating layer 13 is then heat set in a heating zone 14 and then passed through an oven 15 to dry and cure the layer 13.

As shown in FIGS. 6 and 7, the pattern of the coating layer 13 may be generally of mesh or open-weave structure and the layer may be yellow/brown pigmented (or may naturally have this colouration derived from the sand) whereby it simulates a natural woven jute backing.

As shown in greater detail in FIGS. 2 to 5, the roller 9 is rotatably mounted via end supports 20 and is connected to a suitable drive mechanism to effect rotation thereof. The roller 9 is positioned vertically above a rotatably mounted support roller 21 so as to define therebetween a nip through which the carpeting 1 is advanced. The internal roller 12 extends throughout the entire length of the roller 9 and its axis lies on the vertical plane containing the axes of the rollers 9, 21. The roller 12 is mounted at its ends. The feed apparatus 19 comprises a reservoir 22 containing pre-mixed ingredients of the foam-forming mixture. In conventional manner, the mixed ingredients are fed through an outlet pipe 23 to a dispense head together with compressed air and any additional ingredient added at this stage. The head is reciprocated transversely across the width of the carpeting so as to discharge the foam-forming mixture onto the back surface of the carpeting immediately adjacent the perforated roller 9. The mixture is drawn into the roller 9 through the perforations and the dam or well 10 of the material builds up between the carpeting and the internal roller 12. The well of material is generally of uniform thickness along the length of the roller 9. Loss of material beyond the ends of the roller 9 is prevented by fixed end plates 24, 25 which extend respectively between the carpeting and the outer surface of the body 11 of the roller 9 and between the roller 12 and the inner surface of the body 11. The positions of these plates can be pre-adjusted longitudinally of the roller 9 to accommodate a width of carpeting which is smaller than the longitudinal dimension of the roller 9.

Figure 5:
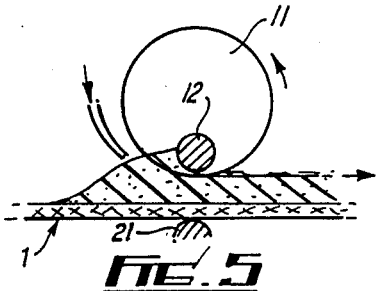

As indicated in FIGS. 4 and 5, the height of the roller 9 above the support roller 21 can be adjusted thereby to adjust the thickness of coating material applied to the back of the carpeting fabric. With the setting of FIG. 5, as the fabric 1 advances through the nip between the rollers 21, 9 irregularities in the adhesive-coated back surface 6 are first filled with coating material from the well 10 thereby producing a relatively even surface which is then contacted by the outer surface of the perforated body 11 of the roller. This outer body surface is liberally covered with the coating material from the well 10 and presses this covering of material onto the filled back surface 6 of the carpeting. At the same time the inner surface of the body 11 is wiped by the fixed roller 12 which has the effect of reducing the amount of coating material at the perforations. There is no such wiping action on the outer surface of the roller 9 so there is no reduction of material on the outer surface of the body 11 of the roller 9 in the vicinity of the solid portions between perforations. Thus, the effect is that slightly more coating material is applied in the vicinity of the solid portions than the perforations. A pattern with raised portions 17 corresponding to the solid parts of the roller 9 and depressed portions 16 corresponding to the perforations of the roller 9 is therefore formed. The embossed pattern is clear and even despite the irregularities on the fabric surface. Accordingly the procedure described provides a method whereby embossed patterns or layers can be applied to irregular surfaces conveniently and with satisfactory control over the thickness and definition of the pattern.

FIGS. 6 and 7 show an applied coating 13 which would be obtained with the arrangement of FIG. 5 i.e. the coating is relatively thick and the depression 16 and ridges 17 are well above the back surface 6. With this arrangement, carpeting having a thick embossed backing layer results.

By using the arrangement shown in FIG. 4, a very thin patterned coating can be applied to the carpeting, for example in simulation of hessian. In this case, the applied coating material may be lightly foamed or even non-foamed. The coating 13 is applied in the same manner as that described above and thus irregularities in the back surface of the carpeting fabric are filled before the embossed pattern is applied. However, the amount of material applied may be relatively insubstantial to the extent that at least some of the irregularities in the carpeting back surface 6 may not be wholly filled at last in the vicinity of the perforations. Thus in the holes or hollows 16 between raised parts 17 of the pattern at least some of the adhesive-coated threads of the back surface 6 of the fabric layer 4 may be exposed. It will be appreciated however that due to the use of the perforated roller 9 and the well of material 10 it is possible to ensure that the applied coating has in general terms a desired average thickness and degree of continuity even where the coating is relatively insubstantial because it can be ensured that at least any deep irregularities are filled and thereby undue disruption of the coating is avoided.

The perforated roller 9 is described above as being drivably rotated. Alternatively it may be freely rotatably mounted so as to be driven by contact with the carpeting, when used with the close arrangement of FIG. 4. Driving of the roller will be necessary with the arrangement of FIG. 5.

The internal roller 12 is described above as being fixed and with this arrangement it acts as a wiper removing excess material from the vicinity of the perforations and returning it to the well 10. Other arrangements are however possible. The roller 12 may be freely rotatable with the roller 9 or it may be positively driven with or against the direction of rotation of the roller 9, and the manner in which the roller 12 is mounted may be such that only one arrangement is possible or such that switching between different arrangements can be effected. Where the roller 12 is positively driven this may be at a fixed speed or provision may be made for varying the speed.

Where the roller 12 rotates in the same direction as the roller 9 the effect is to force coating material back through the perforations to fill the hollows 16 and, if the roller 12 is positively driven at an appropriate speed, to reverse the pattern so that the raised portion of the pattern corresponds to the perforations.

Where the roller 12 rotates contrary to the direction of the roller 9, coating material is particularly effeciently removed from the vicinity of the perforations at the nip and the hollows 16 are deepened. In this case a scraper may be required in contact with the periphery of the roller 12 at the top thereof to return coating material to the well.

The coating material used in the above process may be other than as described in Example 1. Further examples of suitable materials are as follows (parts being parts by weight dry and the percentage solids content of the wet ingredient being in brackets):

EXAMPLE 2

A non-gel foam was made from the following mixed ingredients:

| | |
|---|---|
| Styrene-butadiene rubber latex | 100.00 (65) |
| Dialkyl sodium sulphosuccinamate | 5.00 (35) |
| Sodium hexametaphosphate | 1.00 (20) |
| Antioxidant | 1.00 (100) |
| Zinc oxide | 2.00 (50) |
| Sulphur | 2.00 (50) |
| Zinc diethyldithiocarbamate | 0.75 (50) |
| Mercaptobenzthiazole | 0.75 (50) |
| Limestone (200 mesh BS) | 200.00 (100) |
| Hydroxy propyl methyl cellulose | 0.25 (2.5) |
| Water | 5.83 |
| Total solids content 78% | |
| pH 11.0 | |
| Viscosity 4000–5000 cps | |

EXAMPLE 3

A mechanically foamed mixture was made from the following ingredients, parts being parts by weight:

| | |
|---|---|
| Part A | |
| Copolymer PVC emulsion resin (low temperature fusing paste polymer e.g. Vestorit B7090) | 100.00 |
| Diisooctyl phthalate (Commodity plasticiser DIOP) | 80.00 |
| Calcium carbonate (medium quality filler Snowcal 4ML) | 50.00 |
| Epoxidised linseed oil | 3.00 |
| Barium/zinc stabiliser (with the linseed oil - synergistic heat stabilising system Lankro Mark L2121 Lankro flex ED6) | 2.00 |
| Viscosity depressant (surface active agent Lankro stat V2023) | 2.00 |
| Part B | |
| Silicone surfactant (foaming agent Wacker Silicone A242) | 4.00 |

EXAMPLE 4

A solid paste was made from the following ingredients, parts being parts by weight

| | |
|---|---|
| Copolymer PVC emulsion resin | 100.00 |
| Diisooctyl phthalate | 100.00 |
| Calcium carbonate | 200.00 |
| Epoxidised linseed oil | 3.00 |
| Barium/zinc stabiliser | 2.00 |
| Fine silica (light silica to give thixotropic behaviour - Aerosil 200) | 1 to 2 |
| Pigment | 2.00 |

It is of course to be understood that the invention is not intended to be restricted to the details of the above described embodiments and examples. Thus, for example, with reference to FIG. 1, it is possible to omit the drying oven 18 whereby the coating material is applied by the roller 9 on top of a wet adhesive coating. Also, as appropriate, the roller 12 may be replaced by a flexible wiper blade or other wiping device. The adhesive coating may be applied by spreading rather than using rollers as indicated in FIG. 1. Spreading of the coating material to form the well 10 may be effected by reciprocating the outlet end of the feed pipe 23 rather than the reservoir 22.

The gap between the perforated roller and the surface to be coated can be selected within a relatively wide range and indeed it is an advantage of the invention that both thin and thick layers can be formed in a controlled manner despite irregularities in the surface. Thus, with reference to the embodiment illustrated, the roller 9 and 21 may be set with a relatively large gap (as in FIG. 5) to give a thick coating layer which can be provided with a pronounced decorative embossed pattern. Alternatively the rollers 9 and 21 can be set with a relatively small gap (as in FIG. 4) to give a thin coating layer which may be virtually level with the tufts thereby to give the appearance of jute or hessian at the back of the carpeting. In the latter respect the gap between the rollers 9 and 21 is exaggerated in FIG. 4 for the sake of clarity, and in practice where a jute- or hessian-style finish is required the gap may be such that the roller 9 contacts or almost contacts the surface 1. A preferred range for the thickness of coatings applied with the method of the invention is up to 8 mm. In place of the roller 21 a flat bed or other guide arrangement may be used.

The terms dam and well as used above refer to the body of coating material which accumulates between the surface 1 and the roller 12 or other abutment within the perforated roller 9. That is, the coating material is free to flow through the perforated wall 11 of the roller 9 and excess such material accumulates against the abutment during movement of the surface 1 past the roller 9 to define a distinct reservoir 10 from which material can be drawn and to which material can be added as appropriate.

With the invention it is possible to produce a pronounced embossed pattern or a fine pattern. In the latter case the surface of the coating will be essentially flat or generally flat as mentioned above.

I claim:

1. A method of applying a coating material to a surface, wherein the surface is moved in contact with or in close proximity to a transfer member, comprising: a roller having a perforated outer wall and fluent coating material is fed to the roller wall so as to be deposited therefrom onto the said surface, and wherein the coating material is fed to the outside of the wall so as to establish a well of the material between the wall and the surface, whereby irregularities in the surface are filled and excess material is transferred through the wall to the interior of the roller, wherein the mode of deposition of the material from the perforated roller is such that a raised pattern is formed with the raised portions corresponding to the solid parts of the roller between the perforations.

2. An apparatus for use in applying a coating material to a surface, comprising:

a transfer member in the form of a roller having a perforated outer wall;

a guide arrangement for moving a surface to be coated in contact with or in close proximity to the roller;

a feed arrangement for feeding fluent coating material to the perforated roller to be deposited therefrom onto the surface, wherein said feed arrangement is arranged to supply said fluent coating material to the outside of said perforated outer wall so that it forms a well of such material between the said surface and the said abutment through the perforated wall; and an abutment for the coating material within the perforated roller, wherein said abutment comprises a second smaller roller, wherein the second roller is driven in the opposite direction to the perforated roller.

* * * * *